US008344295B2

(12) United States Patent
Lee et al.

(10) Patent No.: US 8,344,295 B2
(45) Date of Patent: Jan. 1, 2013

(54) NANOSOLDERING HEATING ELEMENT

(75) Inventors: Kwangyeol Lee, Namyangju-si (KR); Donghoon Choi, Seoul (KR)

(73) Assignee: Korea University Research and Business Foundation, Seoul (KR)

( * ) Notice: Subject to any disclaimer, the term of this patent is extended or adjusted under 35 U.S.C. 154(b) by 597 days.

(21) Appl. No.: 12/579,128

(22) Filed: Oct. 14, 2009

(65) Prior Publication Data

US 2011/0084061 A1 Apr. 14, 2011

(51) Int. Cl.
*H05B 3/10* (2006.01)

(52) U.S. Cl. ..... 219/548; 219/547; 219/552; 977/721; 977/723; 977/734; 977/742; 977/784; 977/842; 977/847

(58) Field of Classification Search ..... 219/547, 219/548, 552; 977/721, 723, 734, 742, 784, 977/842, 847

See application file for complete search history.

(56) References Cited

U.S. PATENT DOCUMENTS

| | | | | |
|---|---|---|---|---|
| 2007/0228361 | A1 | 10/2007 | Raravikar et al. | |
| 2008/0248276 | A1 | 10/2008 | Chou et al. | |
| 2009/0235915 | A1 | 9/2009 | Doumanidis et al. | |
| 2010/0151656 | A1 * | 6/2010 | Kim et al. | 438/435 |
| 2010/0165054 | A1 * | 7/2010 | Guan et al. | 347/63 |
| 2011/0021965 | A1 * | 1/2011 | Karp et al. | 602/54 |

OTHER PUBLICATIONS

Guangyu Zhang, et al "Selective Etching of Metallic Carbon Nanotubes by Gas-Phase Reaction" Science,, vol. 314, Nov. 10, 2006, pp. 974-977; DOI: 10.1126/science.1133781.

Stephen Y. Chou, et al "Improved nanofabrication through guided transient liquefaction" Nature Nanotechnology, vol. 3, May 2008, pp. 295-300; DOI: 10.1038/nnano.2008.95.

Dockendorf, et al.: "Individual carbon nanotube soldering with gold nanoink deposition", Applied Physics Letters 90, 193116-1 to 193116-3 (2007).

PCT/KR2010/006898, Jan. 17, 2011, International Search Report.

* cited by examiner

*Primary Examiner* — Meiya Li
(74) *Attorney, Agent, or Firm* — Workman Nydegger

(57) ABSTRACT

Techniques for providing heat to a small area and apparatus capable of providing heat to a small area are provided.

20 Claims, 18 Drawing Sheets

NANOSOLDERING HEATING ELEMENT

BACKGROUND

Providing heat to a very small area is performed in many fields, such as heat activated polymerization on a surface, local chemical transformation, and nano-soldering. In consideration of the size limitation of the area to be heated, it is envisioned that advances in nano-technology may be applied to applications for providing heat to a very small area. A carbon nanotube or a new carbon material, such as graphene, is a prospective for such applications due to its high electrical conductivity and small size.

SUMMARY

Techniques for providing heat to a small area and apparatuses capable of providing heat to a small area are provided. In an illustrative embodiment, by way of non-limiting example, a heating element includes a substrate having at least one wall extending from a portion thereof so as to define a series of a contiguously connected top surfaces thereby, and a conducting layer including conducting materials and being substantially arranged upon the top surfaces, wherein the outermost portion of the at least one wall has an etched portion thereon.

The foregoing summary is illustrative only and is not intended to be in any way limiting. In addition to the illustrative aspects, embodiments, and features described above, further aspects, embodiments, and features will become apparent by reference to the drawings and the following detailed description.

DETAILED DESCRIPTION

Figure 1A:
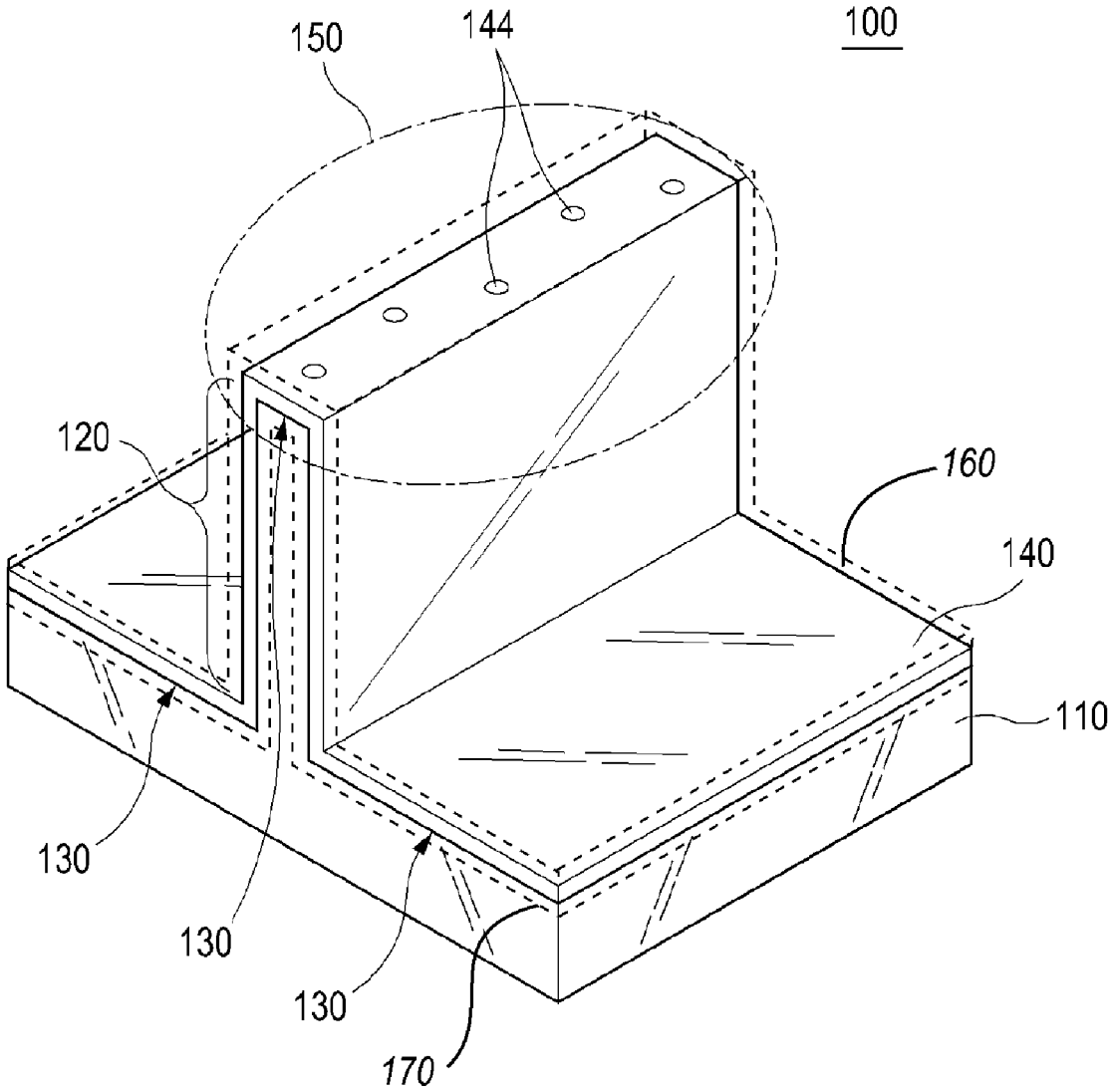
FIG. 1A shows a perspective view of an illustrative embodiment of a heating element.

In the following detailed description, reference is made to the accompanying drawings, which form a part hereof. In the drawings, similar symbols typically identify similar components, unless context dictates otherwise. The illustrative embodiments described in the detailed description, drawings, and claims are not meant to be limiting. Other embodiments may be utilized, and other changes may be made, without departing from the spirit or scope of the subject matter presented herein. It will be readily understood that the aspects of the present disclosure, as generally described herein, and illustrated in the Figures, can be arranged, substituted, combined, separated, and designed in a wide variety of different configurations, all of which are explicitly contemplated herein.

Small-scale structures, such as nanostructures, which may be suitable for creating many new devices with wide-ranging applications, are difficult to fabricate due to their small size. Heating elements with nano-scale heating areas may be applied to fields such as heat activated polymerization on a surface, local chemical transformation, and nano-soldering. Techniques described in the present disclosure employ a novel heating element to locally apply heat to a nano-sized small area. In some embodiments, a heating element has a CNT film arranged on top surfaces thereof, at least one prominent portion of the CNT film being etched so that it has lower conductivity than other remaining portions. Thus, when a voltage is applied to the heating element, the etched portion may operate as resistance and thus be selectively heated. Since the etched portion has a width on the order of nanometers, the area heated is significantly small.

Figure 1B:
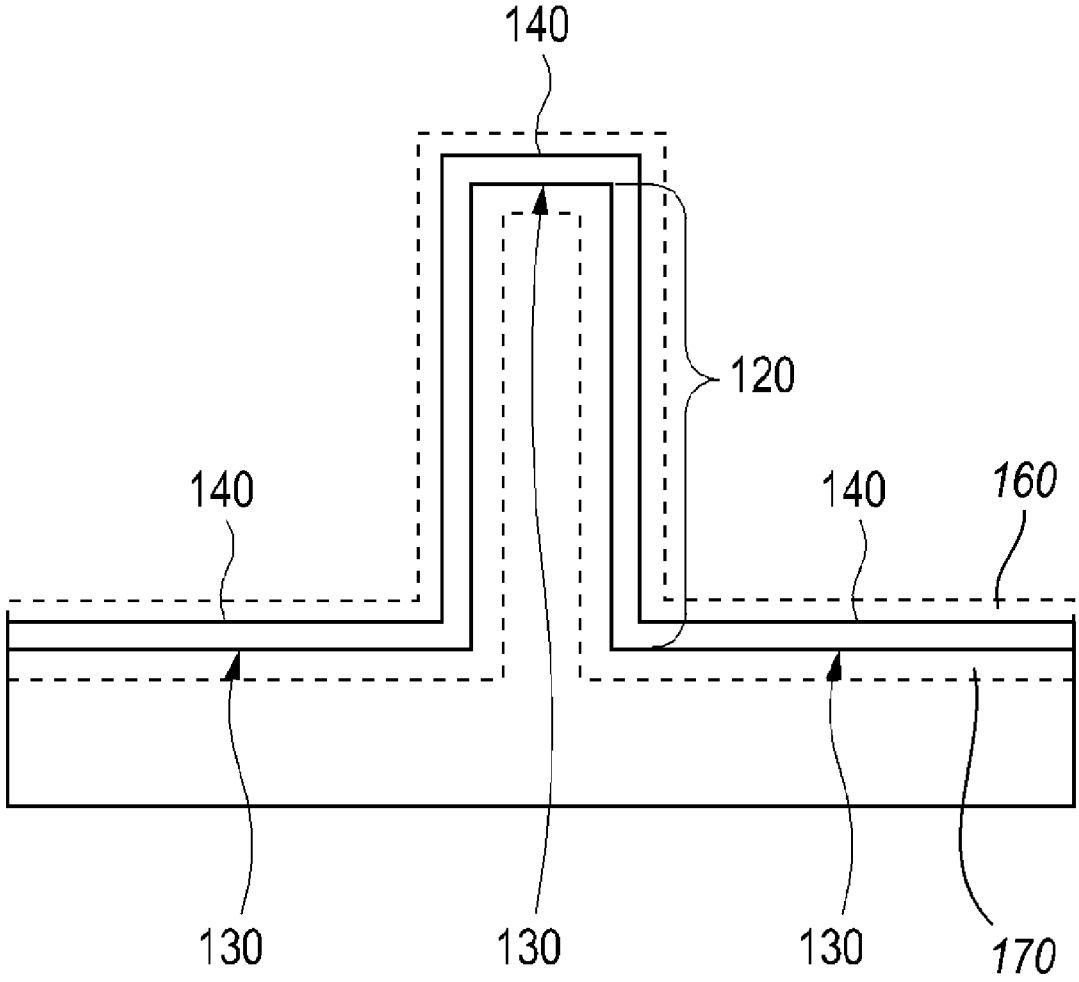
FIG. 1B shows a front view of an illustrative embodiment of a heating element.

FIGS. 1A and 1B respectively show a perspective view and front view of an illustrative embodiment of a heating element 100 that may be used to provide heat to a very small area. As depicted in FIGS. 1A and 1B, heating element 100 may include a substrate 110 that has a prominent portion 120 (hereinafter referred to as "wall"). In one embodiment, wall 120 may extend from a portion of substrate 110 in the direction substantially perpendicular with respect to other portions of substrate 110 and define contiguously connected top surfaces 130. For example, other portions may include parts of substrate 110 that do not form wall 120. In one embodiment, substrate 110 may be fabricated using one of a silicon wafer, glass, or quartz. Heating element 100 may further include a conducting layer. For example, a CNT film 140 may serve as a conducting layer and may be arranged on top surfaces 130 to coat substrate 110 with carbon nanotubes (CNTs). In FIGS. 1A and 1B, the thickness of CNT film 140 is exaggerated for illustration purposes. CNTs include high-aspect ratio microscopic carbon materials, each of which has an outer diameter on the order of nanometers and a length of about 0.5 nanometers to tens of micrometers. In particular, each of the CNTs may have a shape of a hollow cylinder having regularly arranged carbon atoms. CNTs with the above-described features may readily provide an electric field concentration and may provide a high emission current density, and may have highly stable chemical and physical characteristics. An outermost portion 150 of wall 120 may include one or more etched portions 144 that have lower conductivity than other remaining portions of wall 120. If a certain voltage is applied to heating element 100 through an external circuit (not shown), a predetermined current may flow through heating element 100, so that etched portions 144 operate as resistance and result in selective heating thereof.

Figure 2:
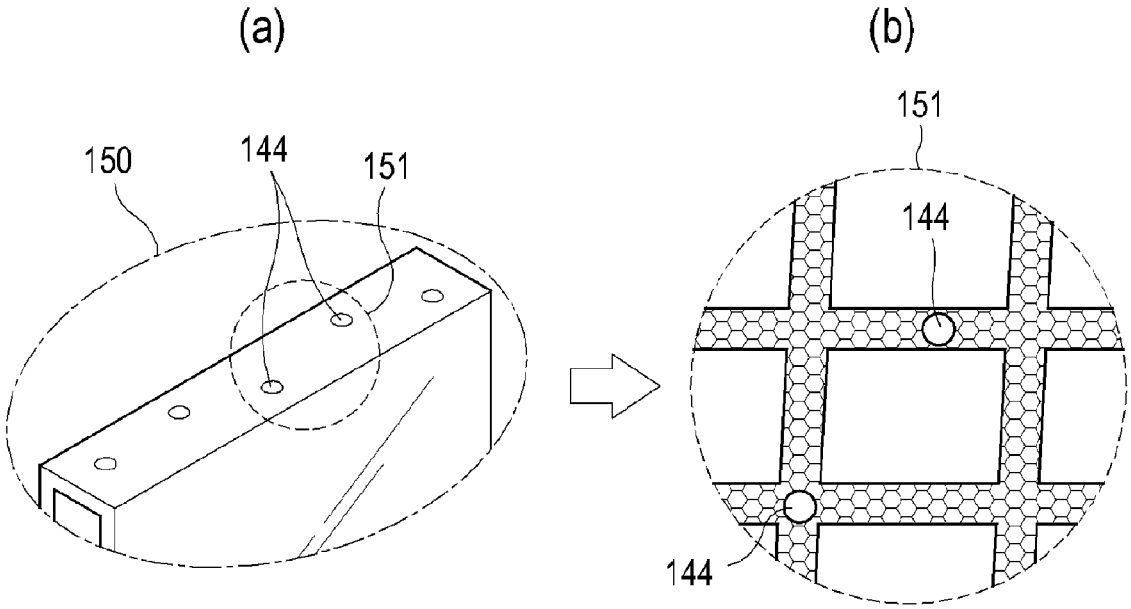
FIG. 2 shows (a) an outermost portion of a wall of the heating element shown in FIG. 1 and (b) an enlarged view of the outermost portion of the wall showing etched portions within a gridlike structure of carbon nanotubes (CNTs).

FIG. 2 shows an enlarged view of an illustrative embodiment of one part 151 of outermost portion 150 of wall 120 of heating element 100. Referring to FIG. 2, CNT film 140 may have a grid-like structure of CNTs, and at least one portion of the grid-like structure of CNTs disposed on outermost portion 150 may be broken to form one or more etched portions 144.

The broken structures of one or more etched portions 144 change the electrical properties of etched portions 144 to increase resistivity of etched portions 144. Thus, conductivity of etched portions 144 may become lower than other portions of wall 120. In this case, if a certain voltage is applied to heating element 100, etched portions 144 may operate as resistance and result in selective heating thereof. Since outermost portion 150 of wall 120 may have a width on the order of nanometers, the area heated in heating element 100 (i.e., substantially etched portions 144) may be significantly small. Heating element 100 having the above-described structure may be suitable for providing heat to a small area for such applications as nano-soldering and local chemical transformation.

In one embodiment, CNT film 140 may include various single-walled carbon nanotubes whose electrical properties are metallic or semiconducting, i.e., semiconducting single-walled carbon nanotubes (SWNTs) or metallic SWNTs. In one embodiment, substrate 110 may be functionalized by a suitable silane so that substrate 110 can have the desired properties. The functionalization introduces chemical functional groups included in the silane to substrate 110 for the desired property. Particularly, if substrate 110 is functionalized by aromatic molecules such as phenyl-terminated silane which is known to interact and selectively bind to metallic SWNTs, metallic SWNTs may be selectively absorbed into substrate 110. In this case, heating element 100 may have higher conductivity compared to one without phenyl-terminated silane. Below is the formula of phenyl-terminated silane used here. Other aromatic molecules for functionalizing substrate 100 may include porphyrins, phthalocyanines, or perylenes.

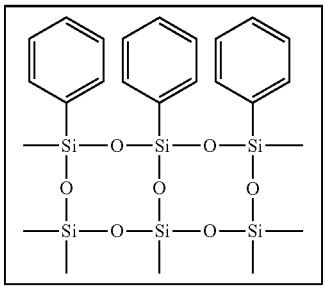

In one embodiment, heating element 100 may have a protection layer 160 substantially arranged upon CNT film 140. The protection layer 160 may be employed to increase the adhesion of CNT film 140 on substrate 110. Due to the existence of the protection layer 160, when the electricity flows to heating element 100 from an outside circuit (not shown), the surface barrier of electrons may be substantially increased upon emission of the electrons. Accordingly, the emission efficiency can be significantly reduced. This may enhance the adhesive strength between substrate 110 having wall 120 and CNT film 140. In some embodiments, a protection layer 160 may be applied to the faces of CNT film 140 at a uniform pressure across the entire surface so that the protection layer 160 may be substantially deposited and maintained thereupon. The thickness of the protection layer 160 may be less than 100 nm. The protection layer 160 may include insulation materials such as silicon dioxide (SiO2), a fluorosilicate glass (FSG), a tetraethyl orthosilicate (TEOS) oxide, a silanol (SiOH), a flowable oxide (FOx), a bottom anti-reflective coating (BARC), an anti-reflective coating (ARC), a photoresist (PR), a near-frictionless carbon (NFC), a silicon carbide (SiC), a silicon oxycarbide (SiOC), and/or a carbon-doped silicon oxide (SiCOH). In an embodiment, heating element 100 may have an insulation layer 170 arranged substantially between the top surfaces 130 and the conducting layer 140.

Figure 3:
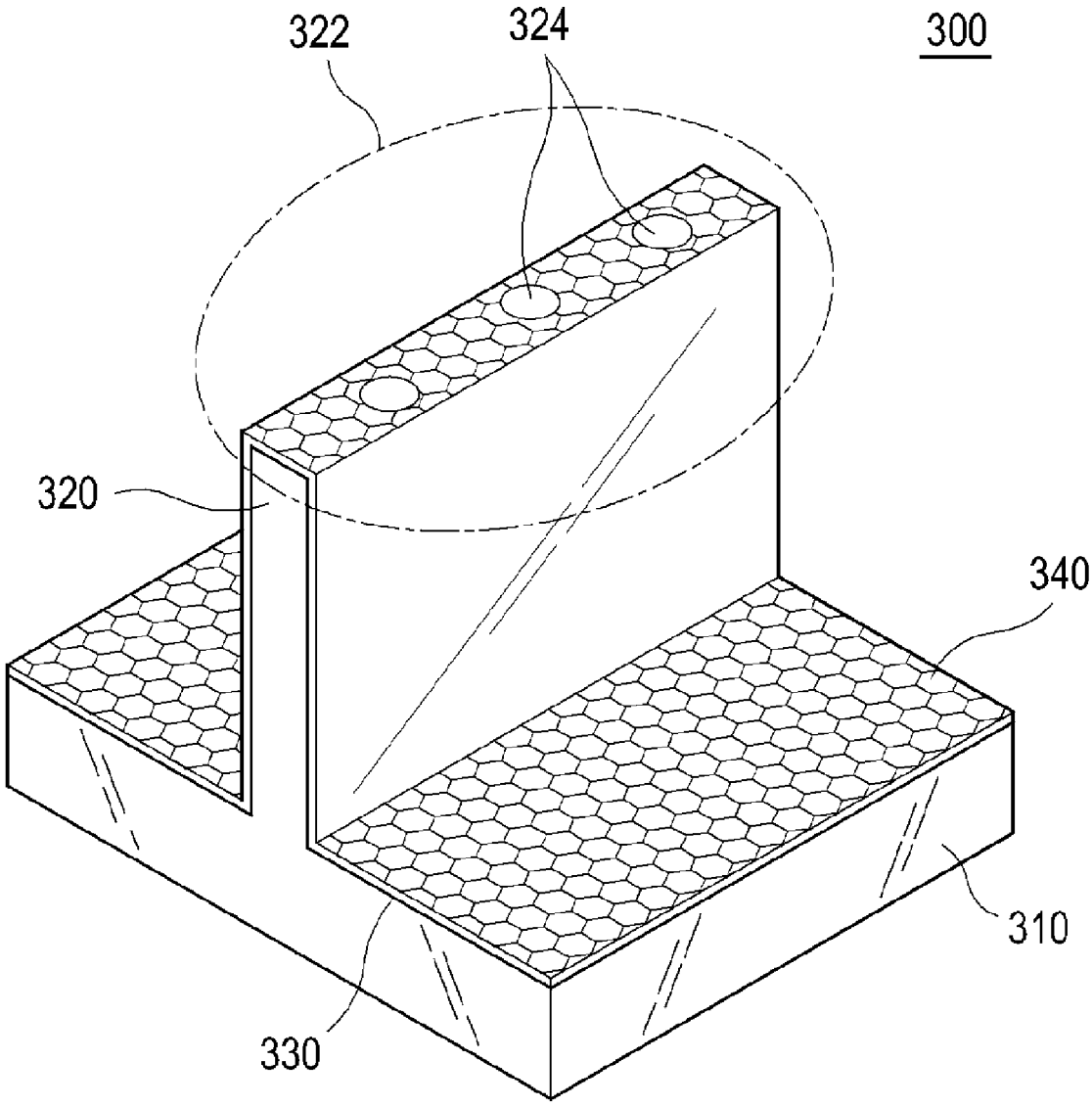
FIG. 3 shows a perspective view of an illustrative embodiment of a heating element to which a graphene sheet is applied.

FIG. 3 shows a perspective view of an illustrative embodiment of a heating element 300 having a graphene sheet 340 on a substrate 310. In this embodiment, heating element 300 may include substrate 310 which has a prominent portion 320 (hereinafter referred to as "wall"). Wall 320 has a similar structure to wall 120 illustrated in FIG. 1 and thus detailed descriptions thereof are omitted. Further, substrate 310 may be fabricated using one of a silicon wafer, glass, or quartz. Graphene sheet 340 may be arranged on top surfaces 330 of substrate 310 to coat substrate 310 with graphene. Graphene sheet 340 includes polycyclic aromatic molecules in which multiple carbon atoms are covalently bound to each other. The covalently bound carbon atoms form 6-membered rings as a repeating unit and may additionally form 5-membered rings and/or 7-membered rings. Accordingly, graphene sheet 340 may appear as if the covalently bound carbon atoms form a single layer thereby. Graphene sheet 340 may have various structures depending on the amount of 5-membered rings and/or 7-membered rings included therein. Graphene sheet 340 may have one or more layers of graphene, which may have a thickness of about 100 nm. Graphene sheet 340 with the above-described features may readily provide an electric field concentration, may provide a high emission current density, and have highly stable chemical and physical characteristics.

An outermost portion 322 of wall 320 may have one or more etched portions 324. In some embodiments, oxygen plasma treatment may be conducted to etch graphene sheet 340. Since graphene sheet 340 is a sheet of bonded carbons, some of the frame structures of carbons in etched portion 324 are broken. Thus, the conductivity of etched portion 324 may be lower than that of other portions.

Figure 4:
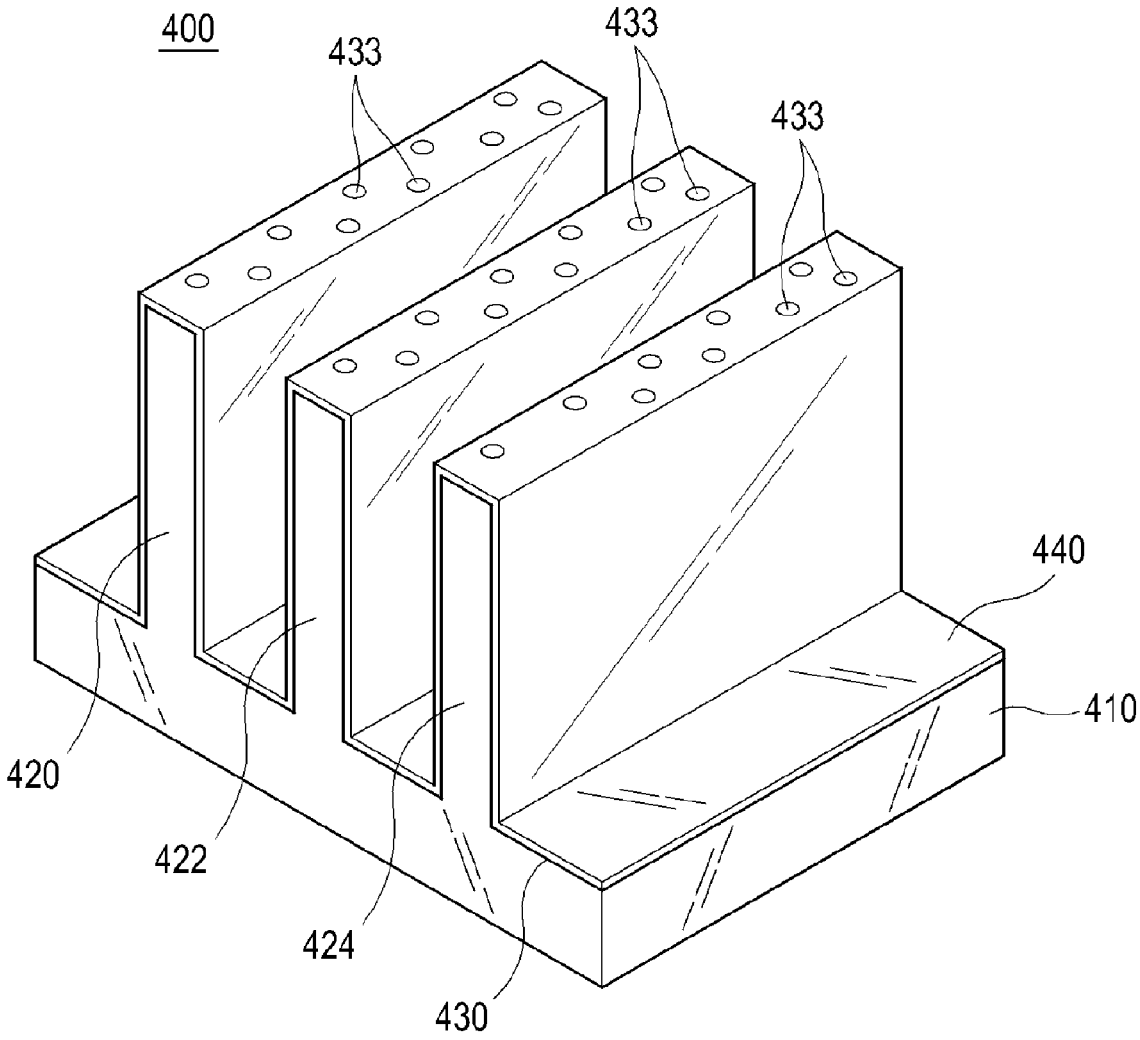
FIG. 4 shows a perspective view of an illustrative embodiment of a heating element having three walls.

FIG. 4 shows a perspective view of an illustrative embodiment of a heating element 400 having more than one wall (for example, three walls 420, 422, and 424) on substrate 410. Heating element 400 has a similar or substantially identical to heating element 100 except that three walls 420, 422, and 424 are formed on substrate 410. Thus, detailed descriptions thereof are omitted. In one embodiment, three walls 420, 422, and 424 have width and height of several hundreds of nanometers. Heating element 400 has contiguously connected top surfaces 430, and on top surfaces 430, CNT film 440 may be arranged. Further, each of walls 420, 422, and 424 has one or more etched portions 433 having the increased resistivity. If voltage is applied to heating element 400 through an outside circuit (not shown), etched portions 433 may be selectively heated. It will be appreciated by those skilled in the art that any variety of walls formed in heating element 400 may be employed.

Figure 5:
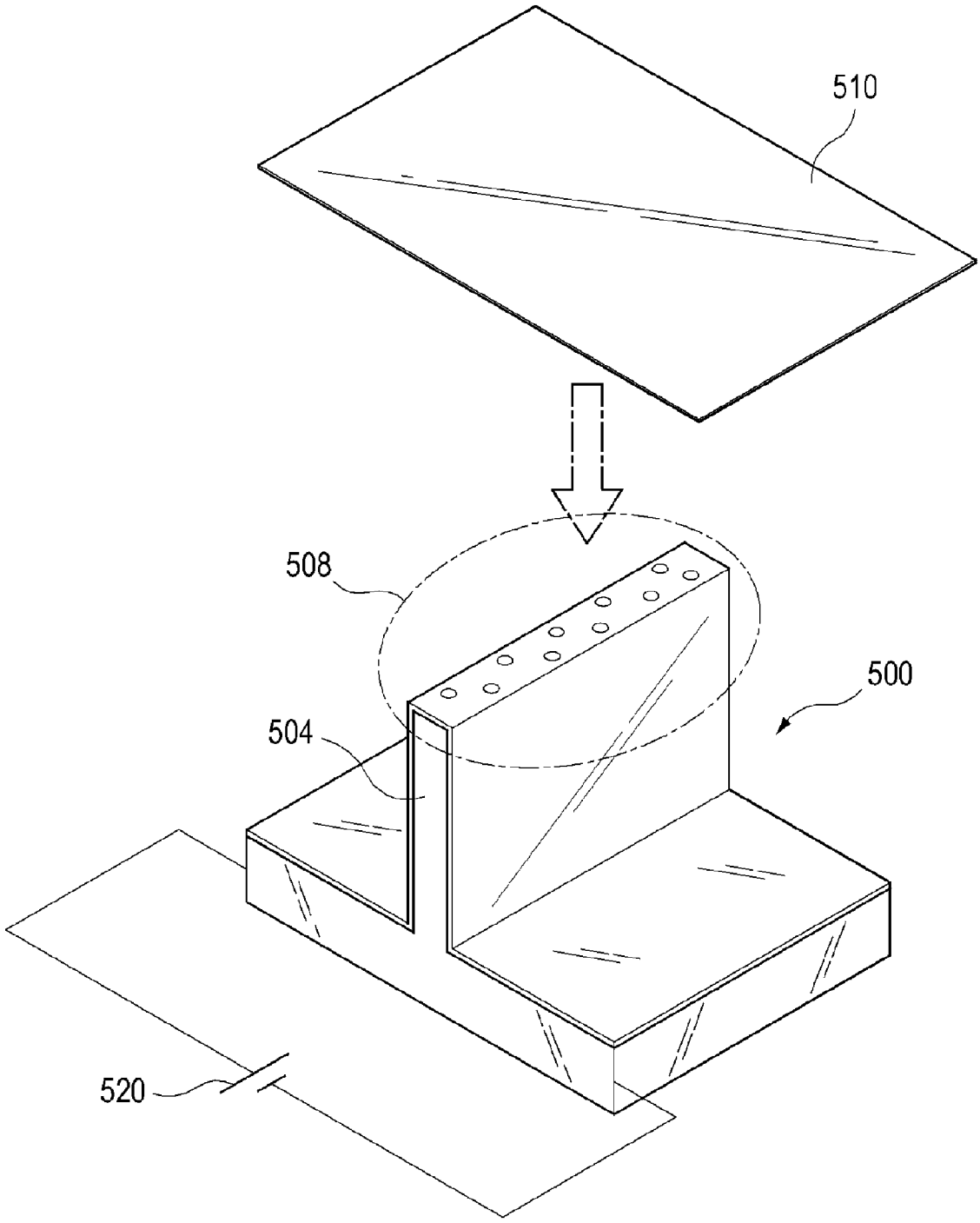
FIG. 5 shows an exploded perspective view of an illustrative embodiment of the heating element shown in FIG. 1 applied to polymerization.

FIG. 5 illustrates an embodiment where a heating element 500 is used for a polymerization. In one embodiment, heating element 500 may have a structure similar to either one of heating elements 100 and 300 illustrated in FIGS. 1 and 3, respectively. Further, an outermost portion 508 of a wall 504 may be etched using the same methods as described above with respect to FIGS. 1 to 3, so that the conductivity of outermost portion 508 may be lower than that of the other portions of wall 504.

For the purpose of polymerization, a polymer material such as a polymer film 510 may be positioned so that one planar surface thereof is faced with outermost portion 508 of wall 504 as shown in FIG. 5. In one embodiment, polymer film 510 may be positioned in contact with outermost portion 508 of wall 504 or positioned at such a certain distance to outermost portion 508 of wall 504 that heat generated from outermost portion 508 may be effectively transferred to polymer film 510. When the electricity flows to heating element 500 from an outside circuit 520, the etched portions in outermost portion 508 of wall 504 may be selectively heated and the heat generated from outermost portion 508 may be transferred to polymer film 510. By being provided heat from heating element 500, heat-activated initiators in polymer film 510 may be activated, thereby conducting polymerization.

Figure 6:
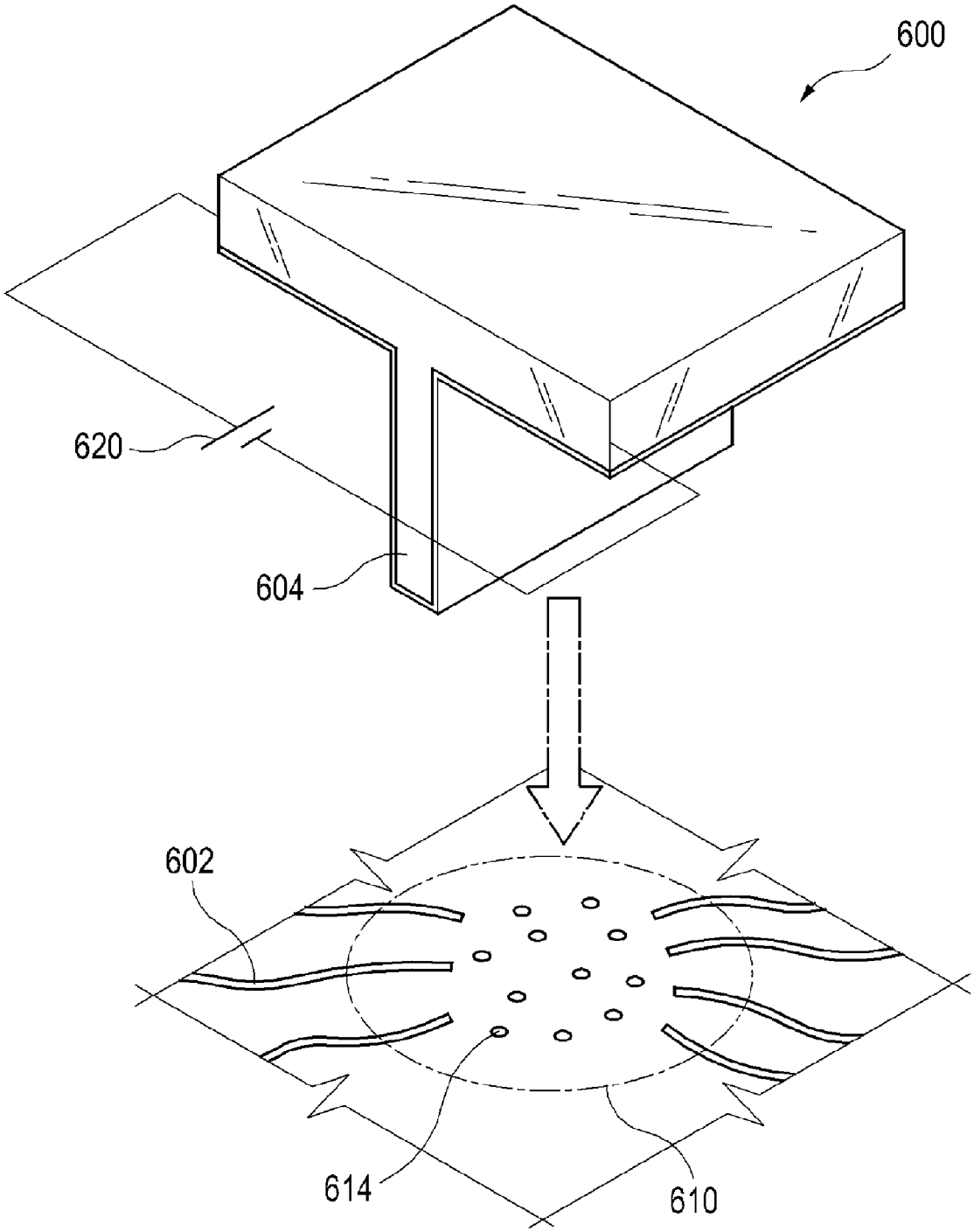
FIG. 6 shows an exploded perspective view of an illustrative embodiment where the heating element shown in FIG. 1 is applied to nanosoldering.

FIG. 6 illustrates another embodiment where a heating element 600 is used for nano-soldering. In one embodiment, heating element 600 may have a structure similar to either one of heating elements 100 and 300 illustrated in FIGS. 1 and 3, respectively. Further, an outermost portion of a wall 604 may be etched using the same methods as described above with respect to FIGS. 1 to 3, so that the conductivity of outermost portion may be lower than that of other portions of wall 604.

For the purpose of nano-soldering, an object (e.g., nanoscale circuit) with nano-materials to be soldered may be positioned so that the nano-materials to be soldered are faced with outermost portion of wall 604 as shown in FIG. 6. In one embodiment, heating element 600 may be arranged so that outermost portion of wall 604 is positioned substantially in contact with or at such a distance to an area 610 of an object to be soldered, where metal particles 614 are pre-arranged between nano-materials 602 to be coupled to each other by soldering. When electricity from an outside circuit 620 flows to heating element 600, the etched portions in outermost portion of wall 604 are heated to solder nano-materials 602 with metal particles 614. In one embodiment, metal particles 614 may be formed on a nanoscale. In such a case, since the melting point of metal particles 614 is much lower than a bulk metal material, metal particles 614 are likely to be melted even with a small amount of heat generated from outermost portion of wall 604.

Figure 7:
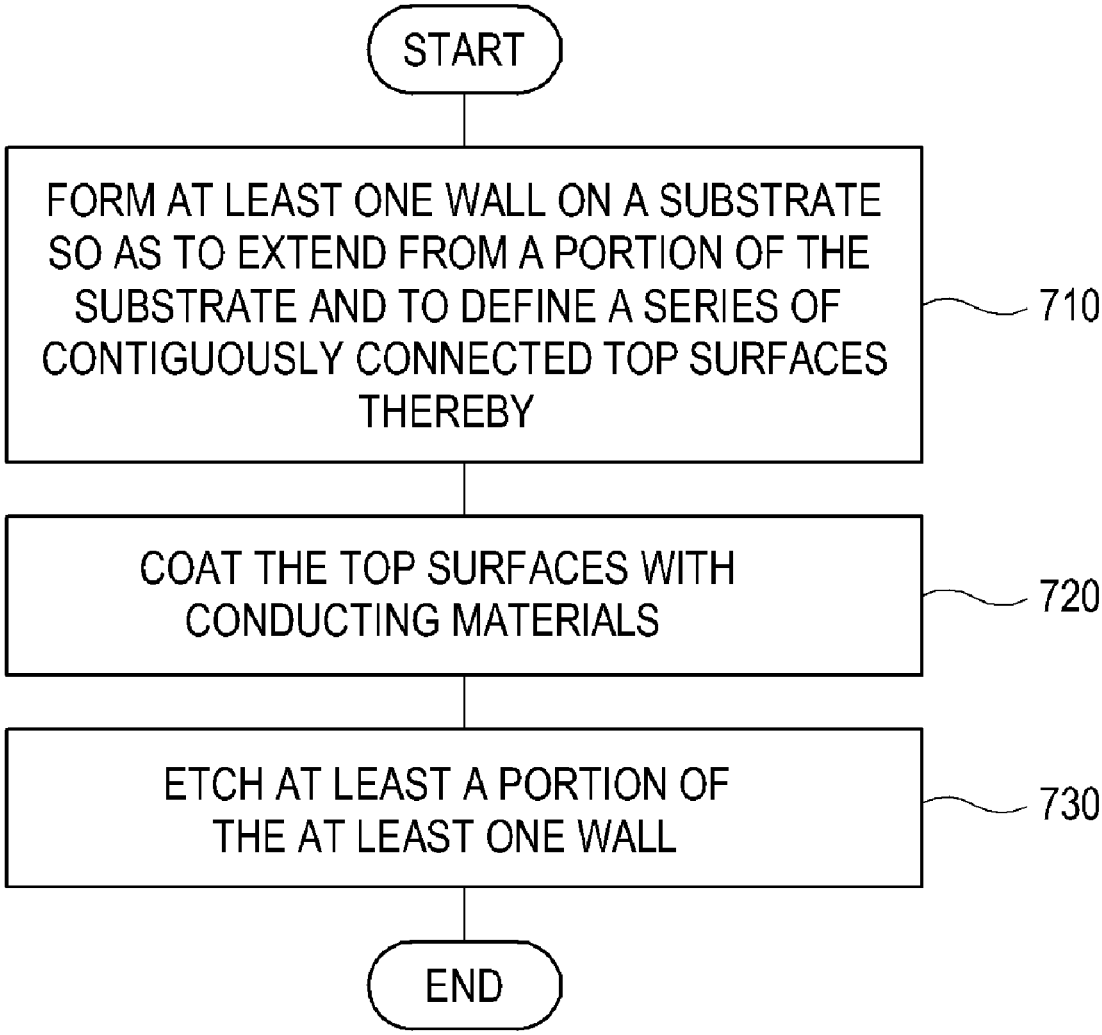
FIG. 7 shows a flow diagram of an illustrative embodiment of a method for manufacturing a heating element that provides heat to a small area.
Figure 8:
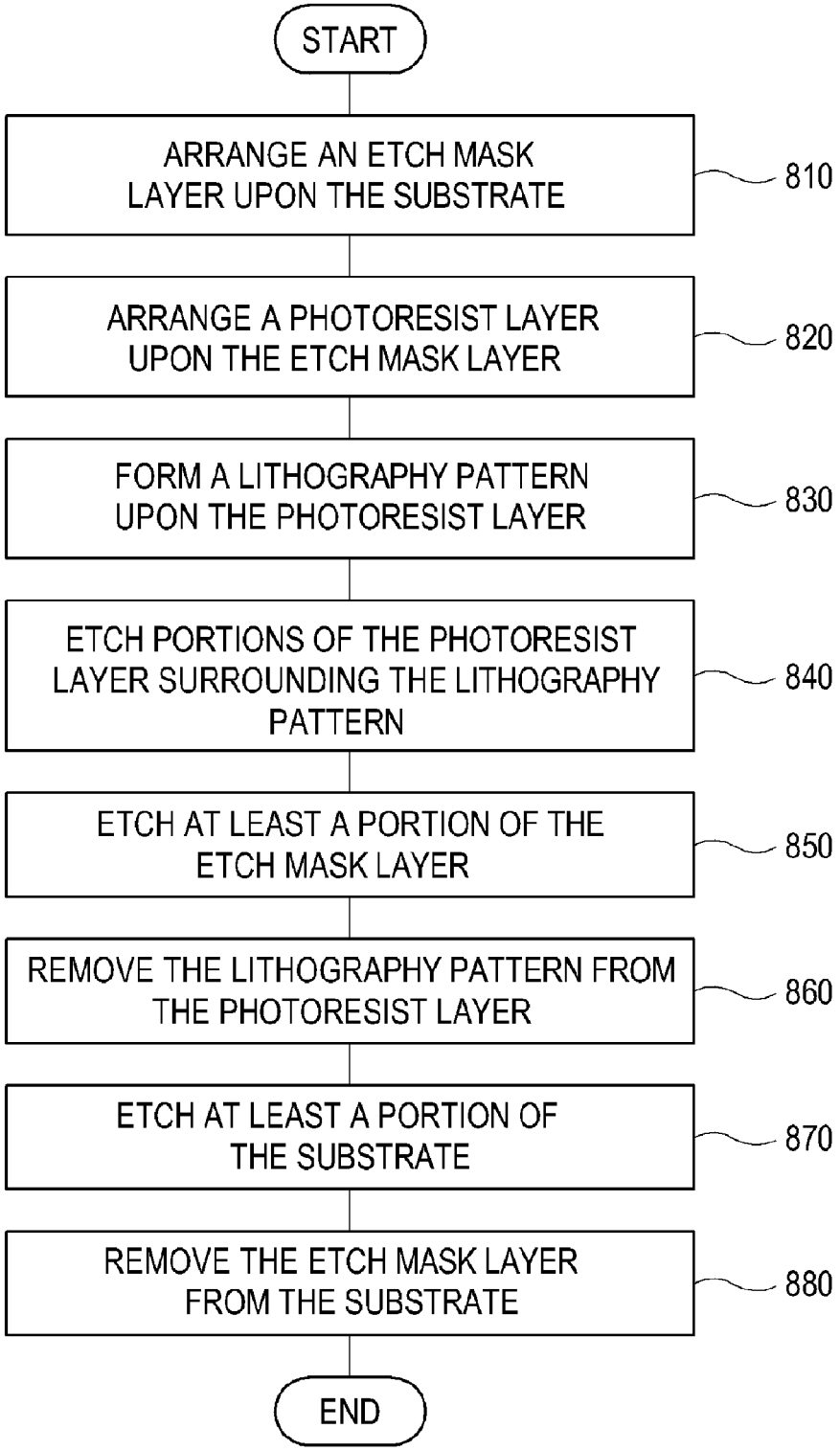
FIG. 8 shows a flow diagram of an illustrative embodiment of a method for forming at least one wall.

FIG. 7 illustrates a flow diagram of an illustrative embodiment of a method for manufacturing a heating element that provides heats to a small area. The heating element may be manufactured by forming at least one wall on a substrate (block 710), coating a top surface of the wall with coating materials (block 720), and etching at least a portion of the at least one wall (block 730). Referring FIG. 8 and FIGS. 9A-9H, a detail description for the method of FIG. 7 will be provided hereinafter. FIG. 8 shows a flow diagram of an illustrative embodiment of a method for forming at least one wall on a substrate. FIGS. 9A-9H show a series of diagrams illustrating the method shown in FIG. 8.

Figure 9A:
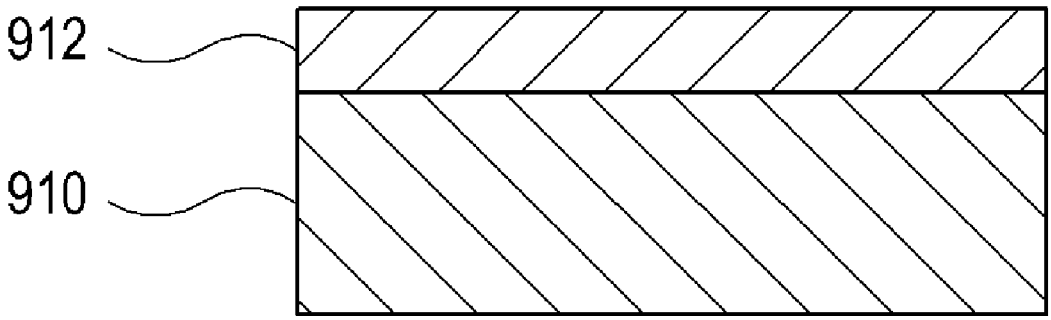
FIGS. 9A-9H show a series of diagrams illustrating the method shown in FIG. 8.
Figure 9B:
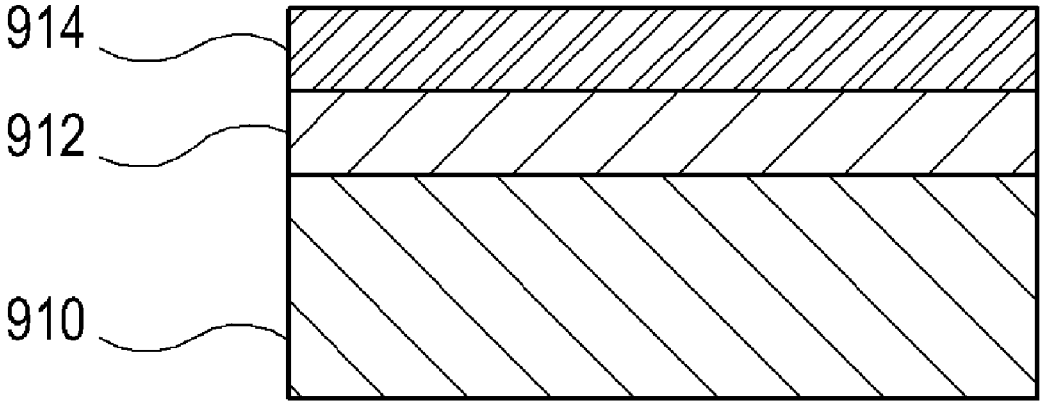
Figure 9C:
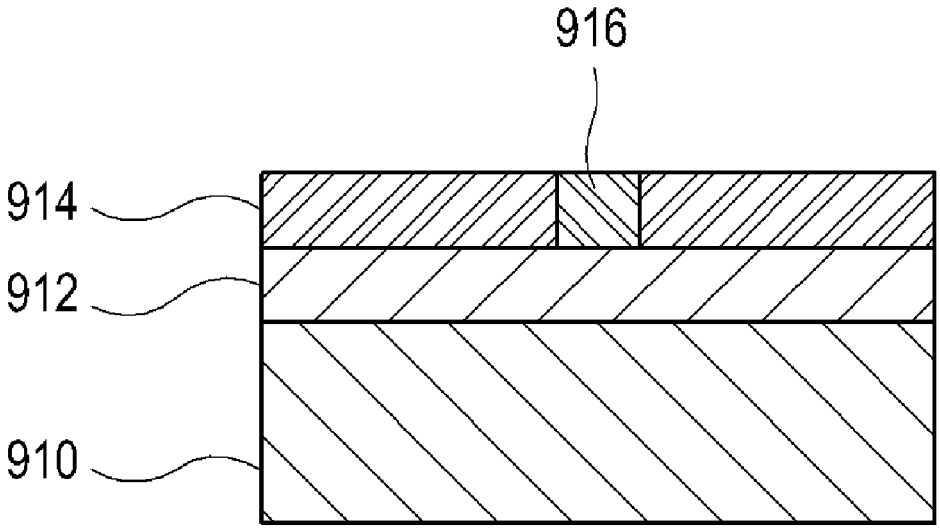
Figure 9D:
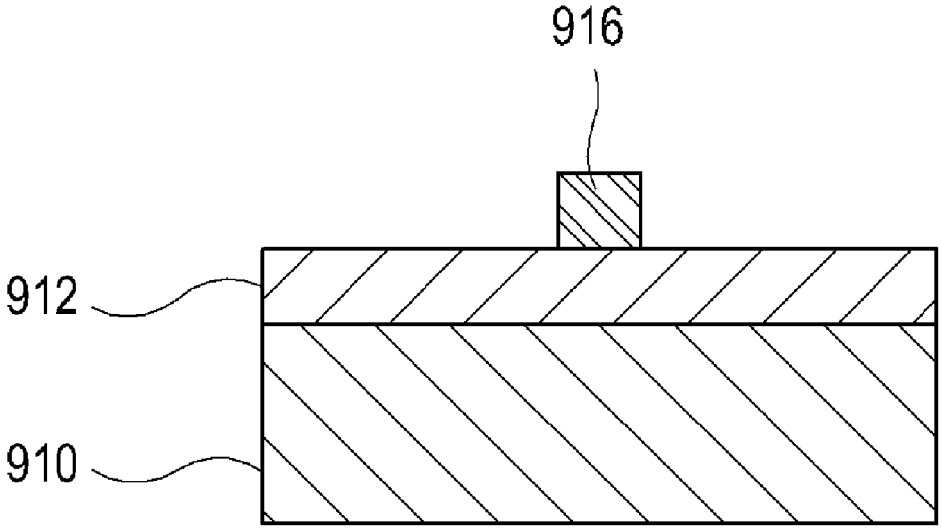
Figure 9E:
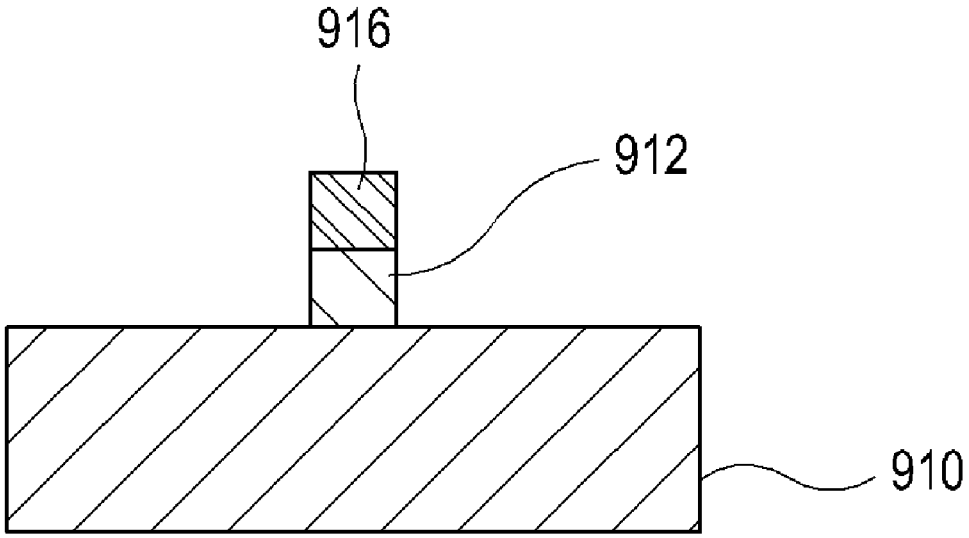
Figure 9F:
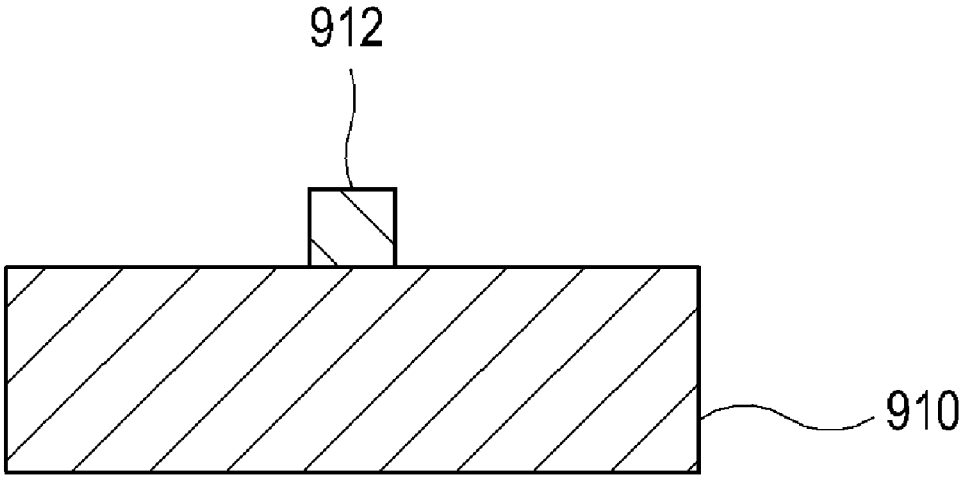
Figure 9G:
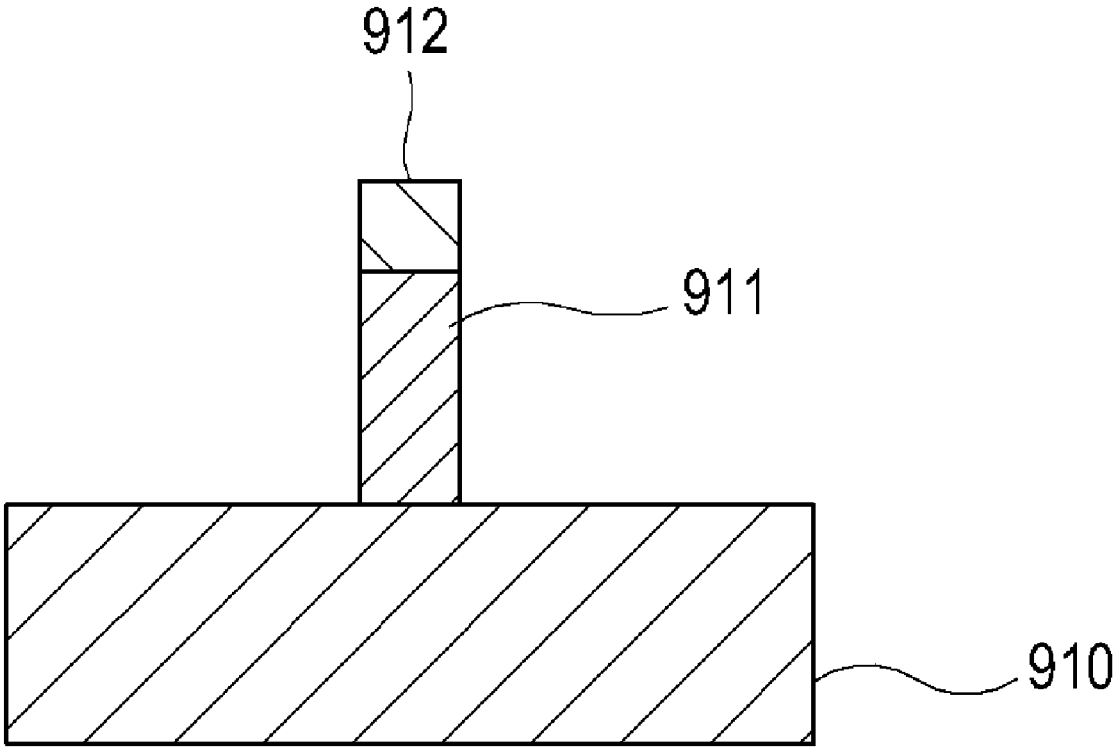
Figure 9H:
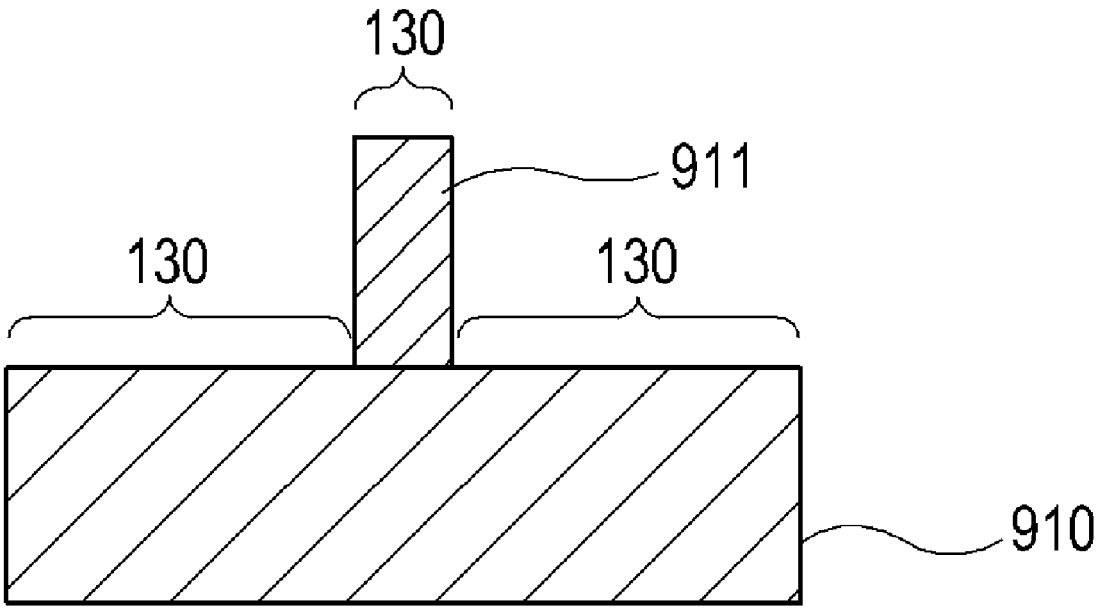

Referring to FIG. 9A, an etch mask layer 912 is arranged upon a substrate 910, such as a silicon wafer, glass, or quartz, by using any of a variety of well-known fabrication process such as chemical vapor deposition or photolithographic techniques. Etch mask layer 912 may be thick enough to provide a pinhole-free etch barrier for subsequent processing and may be sufficiently thin to accurately register the extreme submicron dimensions. Etch mask layer 912 may include materials, such as $Si_3N_4$, $SiO_2$, or tungsten. As shown in FIG. 9B, a photoresist layer 914 is arranged upon etch mask layer 912 (block 820). In one embodiment, photoresist layer 914 may be about 150 nm to about 200 nm thick. Referring to FIG. 9C, photoresist layer 914 is exposed using conventional lithography techniques to form an appropriate lithography pattern 916. Photoresist layer 914 is etched (block 840) as shown in FIG. 9D so that lithography pattern 916 remains on etch mask layer 912. In FIG. 9E, etch mask layer 912 is etched (block 850) in a manner so that a portion of etch mask layer 912 arranged below lithography pattern 916 remains on substrate 910. In one embodiment, if etch mask layer 912 includes nitride material, $CF_4$ etchant may be used to etch mask layer 912. The remaining photoresist layer (i.e., lithography pattern 916) is removed by suitable etching process (block 860), as shown in FIG. 9F. FIG. 9G illustrates substrate 910 prior to etching and, as shown in FIG. 9G an etching process is performed on substrate 910 (block 870) so that a portion of substrate 910 arranged below etch mask layer 912 remains while the other portions of substrate 910 are etched. Accordingly, after the etching process is completed, a wall 911 (i.e., prominent portion) is formed between etch mask layer 912 and the un-etched portion of substrate 910, as shown in FIG. 9G. In one embodiment, the etching process in blocks 840, 850, and 870 may be conducted using well-known etching techniques such as a KOH etching process, or plasma etching. The regions of exposed substrate 910, on which no wall 911 is formed, are etched with a highly anisotropic etching process such as KOH wet etching. Alternatively, other anisotropic etching processes such as reactive-ion etching or ion-milling may be used. Etch mask layer 912 is removed by a suitable etching process (block 880) as shown in FIG. 9H, so that wall 911 remains on substrate 910. Since wall 911 has a material identical to that of substrate 910 and is formed by etching some portions of substrate 910, a series of continuously connected top surfaces 130 is formed on substrate 910.

Referring again to FIG. 7, a conducting layer is arranged on top surfaces which are defined by the substrate and the wall (block 720). In one embodiment, a conduction layer such as a CNT film may be arranged on the top surfaces. The CNT film may be formed by any one of the transfer, coating, spraying, or screen printing methods. Alternatively, the top surfaces may be coated with CNTs by using conventional coating techniques such as wet coating including spraying, dipping and roll coating, or dry coating. In another embodiment, a graphene sheet may be used as the conducting layer. The graphene sheet may be prepared by a micromechanical method or a SiC thermal decomposition. In the micromechanical method, a graphene sheet separated from graphite can be prepared on the surface of a tape (e.g. tape sold under the trade name "Scotch") by attaching the tape to a graphite sample and detaching the tape. In the SiC thermal decomposition, SiC single crystal is heated to remove Si by decomposition of the SiC on the surface, and then residual carbon C forms a graphene sheet.

An outermost portion of the wall is etched (block 730). In one embodiment, plasma etching such as $O_2$ plasma etching, or methane plasma etching may be conducted to etch the outermost portion of the wall. Through the etching process, the carbon structures of conducting materials, i.e., CNTs or graphenes, are broken, and thus the conductivity of the outermost portion of the wall becomes lower than that of the other portions. In one embodiment, a protection layer may be further arranged on the conducting layer. The protection layer may be formed by sputtering or by a vapor deposition method such as Chemical Vapor Deposition (CVD).

Figure 10:
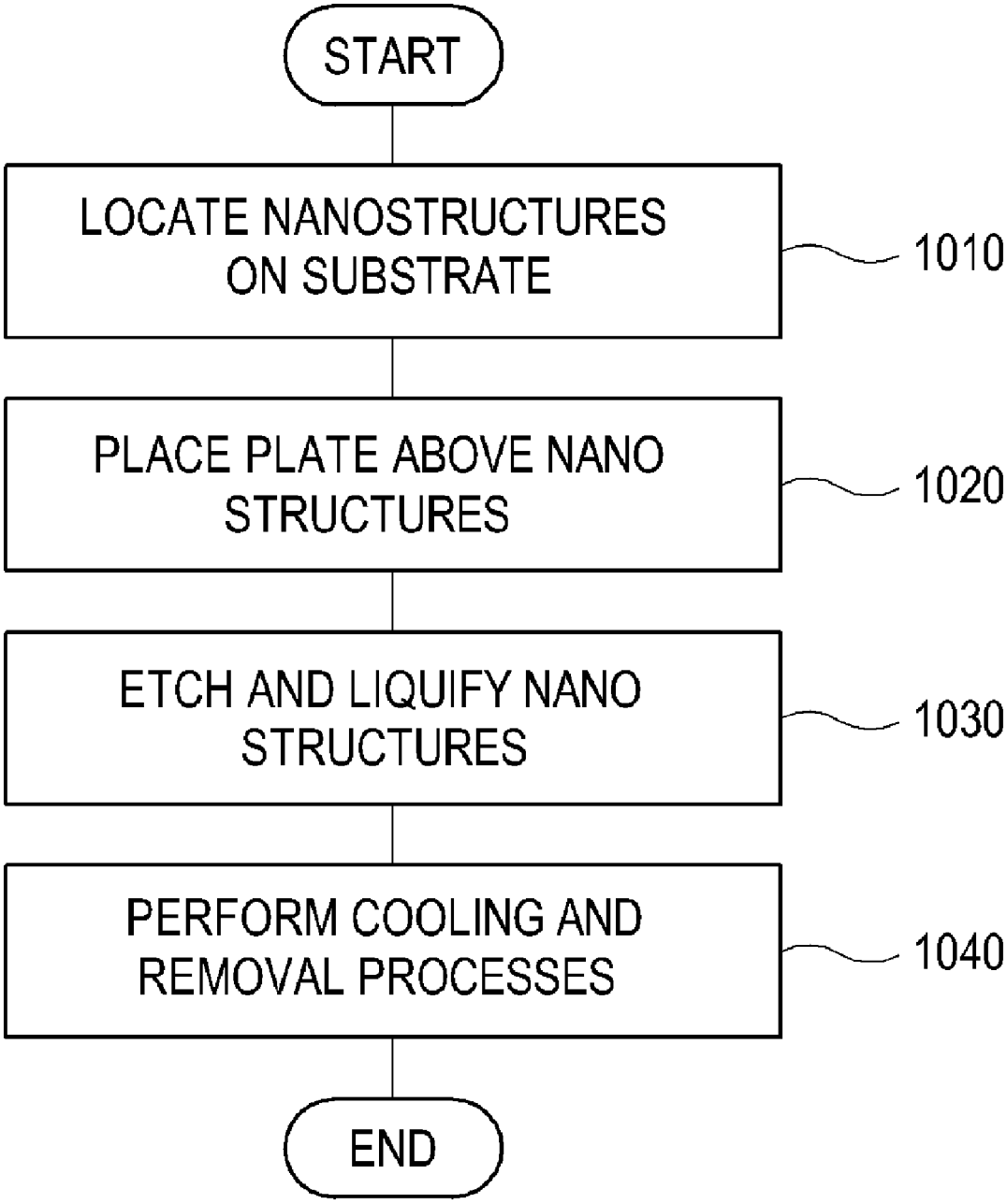
FIG. 10 shows a flow diagram of another illustrative embodiment of a method for forming at least one wall on the substrate.
Figure 11A:
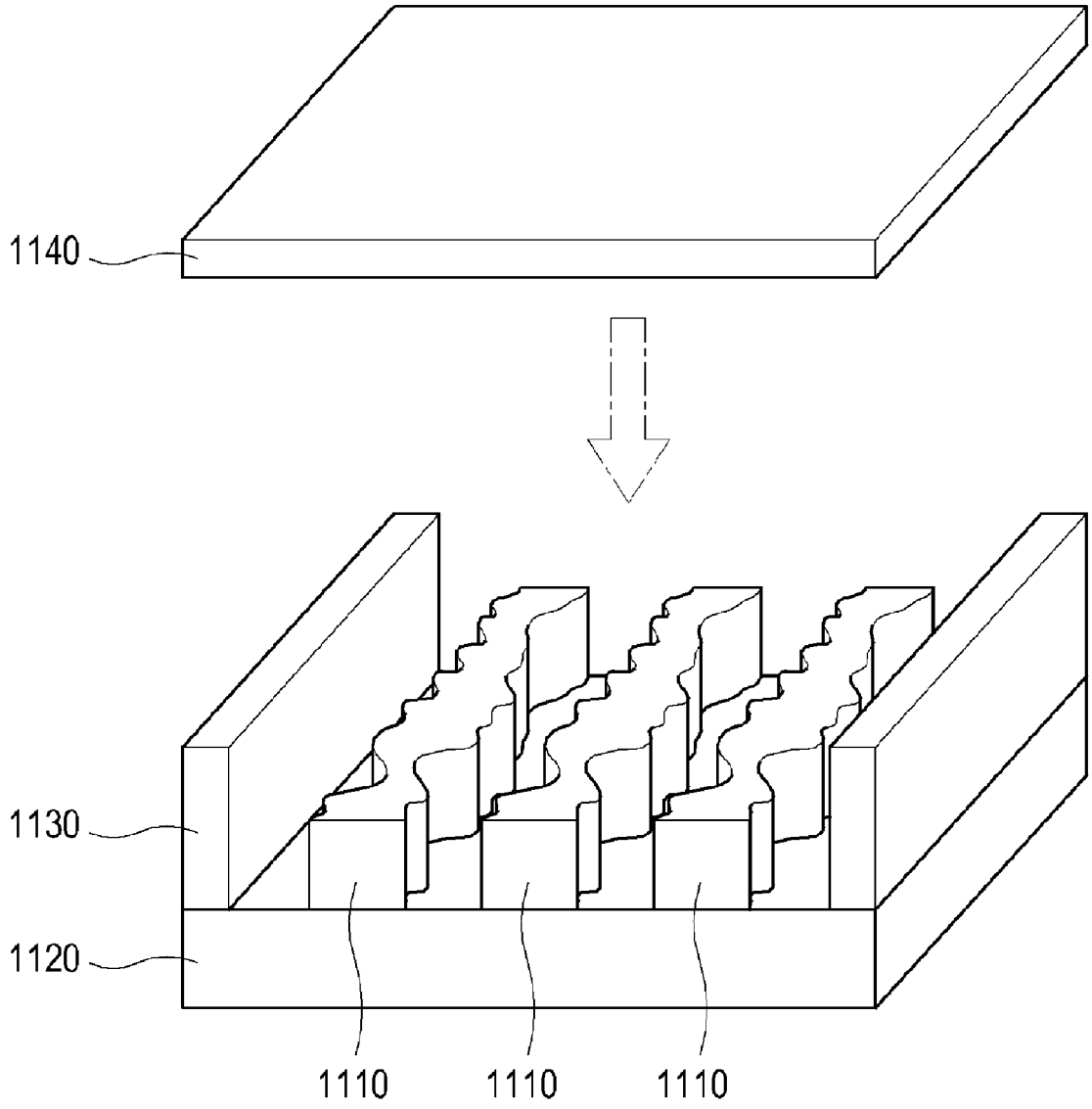
FIGS. 11A-11C show a series of diagrams illustrating the method shown in FIG. 10.
Figure 11B:
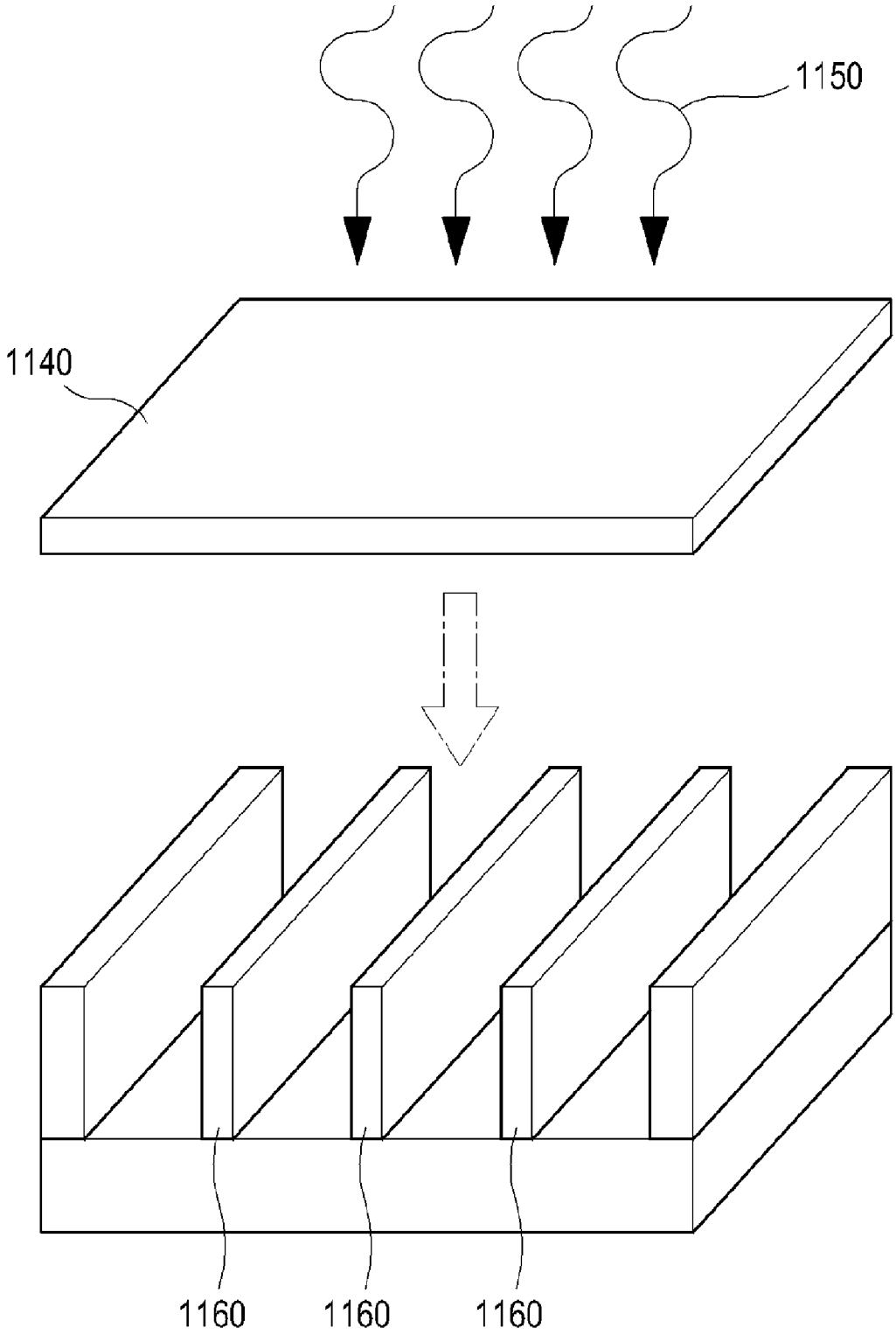
Figure 11C:
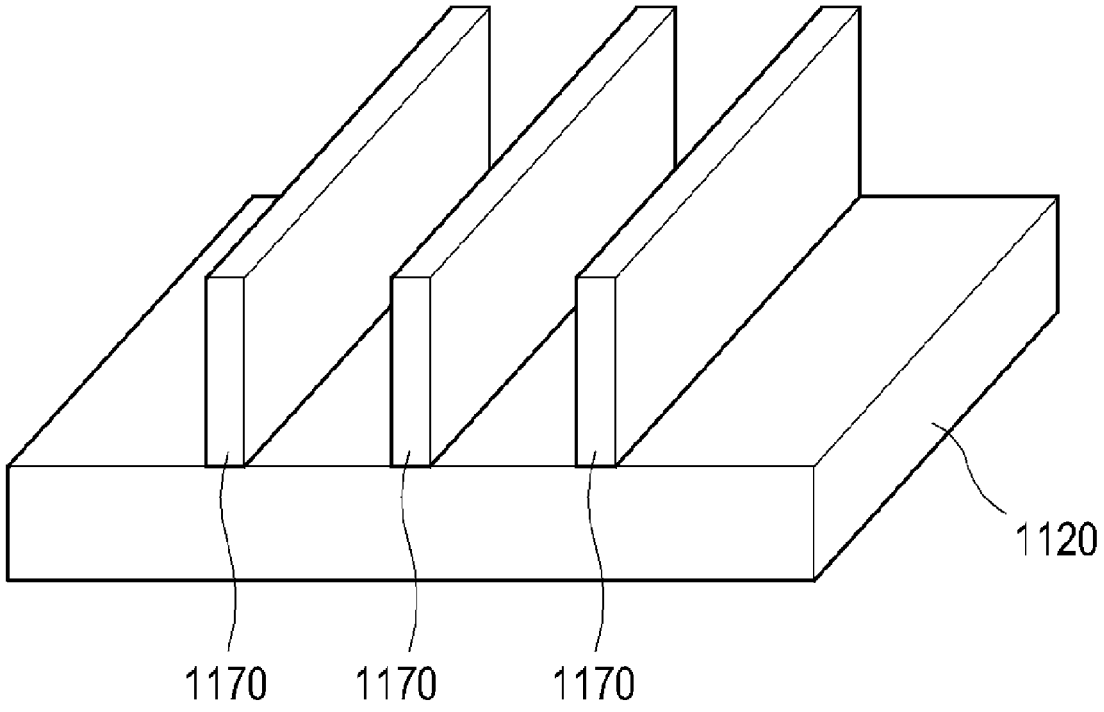

FIG. 10 shows a flow diagram of another illustrative embodiment of a method for forming multiple walls on the substrate. FIGS. 11A-11C show a series of diagrams illustrating the method shown in FIG. 10. As shown in FIG. 11A, multiple nanostructures 1110 each made of silicon or chromium are located on a substrate 1120. Nanostructures 1110 may be prepared in advance using any of a variety of well-known fabrication techniques, such as lithography, etching, or deposition techniques. A plate 1140 is placed above nanostructures 1110 (block 1020) so that a certain gap is formed between nanostructures 1110 and plate 1140. In one embodiment, local spacers 1130 may be arranged on substrate 1120 for plate 1140 to maintain a predetermined gap with nanostructures 1110. For the purposes of illustration, plate 1140 is illustrated as being detached from the remaining structures (local spacers 1130, nanostructure 1110, substrate 1120, etc.) Nanostructures 1110 are melted and liquefied by heating (block 1030). Particularly, as shown in FIG. 11B, heating may be performed on plate 1140 by using a laser beam 1150 of a certain wavelength (in the form of either a flood or masked beam), which emits through plate 1140 a certain amount of energy (as depicted in FIG. 11A) to melt nanostructures 1110 (in the solid phase) at a low temperature. Both pulsed and continuous-wave lasers may be used to melt nanostructures 1110. The interaction between nanostructures 1110 and plate 1140 may make the molten nanostructures 1110 rise up (against the liquid surface tension) to reach plate 1140, which forms new shapes of nanostructures 1160, resulting in a greater height and a narrower line width, smooth edges, vertical sidewalls and a flat top. In block 1040, cooling and removal processes are performed, thereby removing spacers 1130 and plate 140 and completing formation of walls 1170 on substrate 1120 as shown in FIG. 11C. Spacers 1130 and plate 140 may not be necessary after walls 1170 are formed on substrate 1120.

It should be appreciated that, for this and other processes and methods disclosed herein, the functions performed in the processes and methods may be implemented in differing order. Furthermore, the outlined steps and operations are only provided as examples, and some of the steps and operations may be optional, combined into fewer steps and operations, or expanded into additional steps and operations without detracting from the essence of the disclosed embodiments.

The present disclosure is not to be limited in terms of the particular embodiments described in this application, which are intended as illustrations of various aspects. Many modifications and variations can be made without departing from its spirit and scope. Functionally equivalent methods and apparatuses within the scope of the disclosure, in addition to those enumerated herein, will be apparent. Such modifications and variations are intended to fall within the scope of the appended claims. The present disclosure is to be limited only by the terms of the appended claims, along with the full scope of equivalents to which such claims are entitled. It is to be understood that this disclosure is not limited to particular methods, reagents, compounds compositions or biological systems, which can, of course, vary. It is also to be understood that the terminology used herein is for the purpose of describing particular embodiments only, and is not intended to be limiting.

With respect to the use of substantially any plural and/or singular terms herein, it should be appreciated that these terms translate from the plural to the singular and/or from the singular to the plural as is appropriate to the context and/or application. The various singular/plural permutations may be expressly set forth herein for sake of clarity.

It should be further appreciated that, in general, terms used herein, and especially in the appended claims (e.g., bodies of the appended claims) are generally intended as "open" terms (e.g., the term "including" should be interpreted as "including but not limited to," the term "having" should be interpreted as "having at least," the term "includes" should be interpreted as "includes but is not limited to," etc.). It should be further understood that if a specific number of an introduced claim recitation is intended, such an intent will be explicitly recited in the claim, and in the absence of such recitation no such intent is present. For example, as an aid to understanding, the following appended claims may contain usage of the introductory phrases "at least one" and "one or more" to introduce claim recitations. However, the use of such phrases should not be construed to imply that the introduction of a claim recitation by the indefinite articles "a" or "an" limits any particular claim containing such introduced claim recitation to embodiments containing only one such recitation, even when the same claim includes the introductory phrases "one or more" or "at least one" and indefinite articles such as "a" or "an" (e.g., "a" and/or "an" should be interpreted to mean "at least one" or "one or more"); the same holds true for the use of definite articles used to introduce claim recitations. In addition, even if a specific number of an introduced claim recitation is explicitly recited, it should be recognized that such recitation should be interpreted to mean at least the recited number (e.g., the bare recitation of "two recitations," without other modifiers, means at least two recitations, or two or more recitations). Furthermore, in those instances where a convention analogous to "at least one of A, B, and C, etc." is used, in general such a construction is intended in the sense one would understand the convention (e.g., "a system having at least one of A, B, and C" would include but not be limited to systems that have A alone, B alone, C alone, A and B together, A and C together, B and C together, and/or A, B, and C together, etc.). In those instances where a convention analogous to "at least one of A, B, or C, etc." is used, in general such a construction is intended in the sense one would understand the convention (e.g., "a system having at least one of A, B, or C" would include but not be limited to systems that have A alone, B alone, C alone, A and B together, A and C together, B and C together, and/or A, B, and C together, etc.). It should be further understood that virtually any disjunctive word and/or phrase presenting two or more alternative terms, whether in the description, claims, or drawings, should be understood to contemplate the possibilities of including one of the terms, either of the terms, or both terms. For example, the phrase "A or B" will be understood to include the possibilities of "A" or "B" or "A and B."

In addition, where features or aspects of the disclosure are described in terms of Markush groups, it is recognized that the disclosure is also thereby described in terms of any individual member or subgroup of members of the Markush group.

It should be further understood, for any and all purposes, such as in terms of providing a written description, all ranges disclosed herein also encompass any and all possible subranges and combinations of subranges thereof. Any listed range can be easily recognized as sufficiently describing and enabling the same range being broken down into at least equal halves, thirds, quarters, fifths, tenths, etc. As a non-limiting example, each range discussed herein can be readily broken down into a lower third, middle third and upper third, etc. It should also be understood that all language such as "up to," "at least," and the like include the number recited and refer to ranges which can be subsequently broken down into subranges as discussed above. Finally, it should also be understood that a range includes each individual member. Thus, for example, a group having 1-3 cells refers to groups having 1, 2, or 3 cells. Similarly, a group having 1-5 cells refers to groups having 1, 2, 3, 4, or 5 cells, and so forth. From the foregoing, it will be appreciated that various embodiments of the present disclosure have been described herein for purposes of illustration, and that various modifications may be made without departing from the scope and spirit of the present disclosure. Accordingly, the various embodiments disclosed herein are not intended to be limiting, with the true scope and spirit being indicated by the following claims.

The invention claimed is:

1. A heating element, comprising:

a substrate including at least one wall extending from a portion thereof so as to define a series of contiguously connected top surfaces; and a conducting layer substantially arranged upon the top surfaces, wherein the conducting layer has an etched portion on an outermost portion of the at least one wall.

2. The heating element of claim 1, wherein the conducting layer includes at least one graphene sheet.

3. The heating element of claim 1, wherein the conducting layer includes at least one CNT film.

4. The heating element of claim 1, further comprising:

a protection layer arranged substantially upon the conducting layer.

5. The heating element of claim 4, wherein the protection layer includes at least one of metal materials, metal compounds, or insulating materials.

6. The heating element of claim 1, wherein the at least one wall is disposed substantially perpendicular to the substrate.

7. The heating element of claim 1, further comprising:

an insulation layer arranged substantially between the top surfaces and the conducting layer.

8. The heating element of claim 7, wherein a phenyl-terminated silane is further applied to at least a portion of the insulation layer.

9. The heating element of claim 1, wherein the at least one wall has width and height measuring in the range of several hundreds of nanometers.

10. A method for fabricating a heating element, comprising:

forming at least one wall on a substrate so as to extend from a portion of the substrate and to define a series of contiguously connected top surfaces;

coating the top surfaces with conducting materials; and etching at least one portion of the conducting materials to form etched heating element portions that are made from etched portions of the conducting materials that are chemically affected by the etching, wherein the etched heating element portions are distributed in at least one un-etched portion having a lower resistivity than that of respective ones of the etched heating element portions.

11. The method of claim 10, wherein the etching step is performed upon an outermost portion of the at least one wall.

12. The method of claim 10, wherein the coating step includes arranging at least one CNT film upon the top surfaces.

13. The method of claim 10, wherein the coating step includes arranging at least one graphene sheet upon the top surfaces.

14. The method of claim 10, further comprising:

applying a protection layer to the top surfaces having coating applied thereto.

15. The method of claim 14, wherein the protection layer is applied to the top surfaces having coating applied thereto by one of a sputtering and a vapor deposition method.

16. The method of claim 10, the at least one wall is fabricated by using etching techniques.

17. The method of claim 16, wherein the forming step includes:

arranging an etch mask layer upon the substrate;

arranging a photoresist layer upon the etch mask layer;

forming a lithography pattern upon the photoresist layer;

etching portions of the photoresist layer surrounding the lithography pattern;

etching at least a portion of the etch mask layer;

removing the lithography pattern from the photoresist layer;

etching at least a portion of the substrate; and removing the etch mask layer from the substrate.

18. The method of claim 10, wherein the forming includes liquefaction techniques.

19. The method of claim 10, wherein the etching step is conducted by plasma etching.

20. The method of claim 16, wherein the forming step includes:

locating nanostructures on the substrate;

disposing a plate above the nanostructures;

etching and liquefying the nanostructures; and performing cooling and removal processes.

* * * * *

UNITED STATES PATENT AND TRADEMARK OFFICE

CERTIFICATE OF CORRECTION

PATENT NO. : 8,344,295 B2
APPLICATION NO. : 12/579128
DATED : January 1, 2013
INVENTOR(S) : Lee et al.

It is certified that error appears in the above-identified patent and that said Letters Patent is hereby corrected as shown below:

On the Title Page, in Field (56), under "OTHER PUBLICATIONS", in Column 2, Line 1, delete "al" and insert -- al., --, therefor.

On the Title Page, in Field (56), under "OTHER PUBLICATIONS", in Column 2, Line 2, delete "Reaction" Science,," and insert -- Reaction", Science, --, therefor.

On the Title Page, in Field (56), under "OTHER PUBLICATIONS", in Column 2, Line 4, delete "al" and insert -- al., --, therefor.

On the Title Page, in Field (56), under "OTHER PUBLICATIONS", in Column 2, Line 5, delete "liquefaction"" and insert -- liquefaction", --, therefor.

On the Title Page, in Field (56), under "OTHER PUBLICATIONS", in Column 2, Line 7, delete "al.:" and insert -- al., --, therefor.

In the Specifications:

In Column 3, Line 32, delete "100" and insert -- 110 --, therefor.

In Column 3, Line 64, delete "(SiO2)," and insert -- ($SiO_2$), --, therefor.

In Column 6, Line 7, delete "9G" and insert -- 9G, --, therefor.

In Column 7, Line 5, delete "nanostructure" and insert -- nanostructures --, therefor.

In Column 7, Line 21, delete "140" and insert -- 1140 --, therefor.

In Column 7, Line 23, delete "140" and insert -- 1140 --, therefor.

Signed and Sealed this
Seventh Day of May, 2013

Teresa Stanek Rea
*Acting Director of the United States Patent and Trademark Office*

In the Claims:

In Column 10, Line 17, in Claim 16, delete “10,” and insert -- 10, wherein --, therefor.